US012371825B2

(12) United States Patent
Fujisawa et al.

(10) Patent No.: US 12,371,825 B2
(45) Date of Patent: Jul. 29, 2025

(54) INDUSTRIAL FABRIC

(71) Applicant: NIPPON FILCON CO., LTD., Tokyo (JP)

(72) Inventors: Shigenobu Fujisawa, Tokyo (JP); Tsutomu Usuki, Tokyo (JP)

(73) Assignee: NIPPON FILCON CO., LTD., Tokyo (JP)

( * ) Notice: Subject to any disclaimer, the term of this patent is extended or adjusted under 35 U.S.C. 154(b) by 385 days.

(21) Appl. No.: 18/094,107

(22) Filed: Jan. 6, 2023

(65) Prior Publication Data

US 2023/0160110 A1 May 25, 2023

Related U.S. Application Data

(63) Continuation of application No. PCT/JP2021/015441, filed on Apr. 14, 2021.

(30) Foreign Application Priority Data

Jul. 10, 2020 (JP) ..... 2020-119213

(51) Int. Cl.
*D03D 13/00* (2006.01)

(52) U.S. Cl.
CPC ..... *D03D 13/004* (2013.01); *D03D 13/008* (2013.01); *D10B 2403/01* (2013.01); *D10B 2505/00* (2013.01)

(58) Field of Classification Search
None
See application file for complete search history.

(56) References Cited

U.S. PATENT DOCUMENTS

2003/0217782 A1 11/2003 Nagura et al.
2004/0231745 A1 11/2004 Quigley et al.
2005/0268981 A1 12/2005 Barratte
2006/0048840 A1 3/2006 Quigley
(Continued)

FOREIGN PATENT DOCUMENTS

CN 103443356 A 12/2013
JP 2004036052 A 2/2004
(Continued)

OTHER PUBLICATIONS

International Search Report issued in Appplication No. PCT/JP2021/015441, mailed Jul. 6, 2021.
(Continued)

*Primary Examiner* — Arti Singh-Pandey
(74) *Attorney, Agent, or Firm* — Michael Best & Friedrich LLP

(57) ABSTRACT

An industrial fabric 100 is an industrial fabric in which an upper surface side fabric composed of upper surface side warps and upper surface side wefts and a lower surface side fabric composed of lower surface side warps and lower surface side wefts are bound to each other, wherein an upper surface side warp 1Ub functions as an upper surface side binding yarn binding the upper surface side fabric and the lower surface side fabric, and a lower surface side warp 2Lb functions as a lower surface side binding yarn binding the upper surface side fabric and the lower surface side fabric. The number of knuckles formed by the upper surface side warp 1Ub in the upper surface side fabric is larger than the number of knuckles formed by the lower surface side warp 2Lb in the upper surface side fabric.

12 Claims, 8 Drawing Sheets

(56) References Cited

U.S. PATENT DOCUMENTS

| | | | |
|---|---|---|---|
| 2006/0278297 | A1 | 12/2006 | Ueda |
| 2008/0149214 | A1 | 6/2008 | Quigley |

FOREIGN PATENT DOCUMENTS

| | | | |
|---|---|---|---|
| JP | 2004156164 | A | 6/2004 |
| JP | 2005-524781 | A | 8/2005 |
| JP | 2005-350844 | A | 12/2005 |
| JP | 2006-348403 | A | 12/2006 |
| JP | 2010-126862 | A | 6/2010 |
| JP | 2013-224507 | A | 10/2013 |
| WO | 2019/159829 | A1 | 8/2019 |

OTHER PUBLICATIONS

International Preliminary Report on Patentability issued in Application No. PCT/JP2021/015441, issued Jan. 10, 2023.
Article 94(3) EPC Communication issued in European Application No. 21838541.7, dated Jul. 8, 2024.
Office Action issued in Chinese Application No. 202180023124.X, dated Oct. 26, 2024.
Office Action issued in Canadian Application No. 3,185,314, mailed Mar. 6, 2025.

200

300

400

INDUSTRIAL FABRIC

TECHNICAL FIELD

The present invention relates to industrial fabrics used for paper machines.

BACKGROUND ART

In the related art, papermaking meshes made of warps and wefts have been widely used as industrial fabrics for paper machines. The properties required for papermaking meshes vary. For example, as an industrial fabric in consideration of surface smoothness, an industrial fabric has been devised. The industrial fabric includes: an upper surface side fabric including upper surface side warps and upper surface side wefts; and a lower surface side fabric including lower surface side warps and lower side wefts, wherein an upper surface side weave repeat is formed by an upper surface side warp texture consisting of a set of two warps in the upper surface side fabric, the set of two warps is a warp binding yarn having a function of binding the upper surface side fabric and the lower surface side fabric, and the warp binding yarn is woven with a lower surface side weft at the same part where lower surface side warps are interwoven with a lower surface side weft (see Patent Literature 1).

[Patent Literature 1] US Patent Application Publication NO. 2006/0048840

SUMMARY OF INVENTION

Technical Problem

However, in the industrial two-layer fabric described above, since the two warp binding yarns have the same texture, the intersections are regularly arranged. Therefore, marks due to the intersections are more likely to be generated.

In this background, one of exemplary purposes of the present invention is to provide a new industrial fabric that suppresses the generation of marks.

Solution to Problem

An industrial fabric according to one embodiment of the present invention is an industrial fabric in which an upper surface side fabric composed of upper surface side warps and upper surface side wefts and a lower surface side fabric composed of lower surface side warps and lower surface side wefts are bound to each other, wherein a first warp that belongs to the upper surface side warps functions as an upper surface side binding yarn that binds the upper surface side fabric and the lower surface side fabric, a second warp that belongs to the lower surface side warps functions as a lower surface side binding yarn that binds the upper surface side fabric and the lower surface side fabric, the number of knuckles formed by the upper surface side binding yarn in the upper surface side fabric is larger than the number of knuckles formed by the lower surface side binding yarn in the upper surface side fabric, and the number of the lower surface side warps is twice the number of the upper surface side warps.

According to this embodiment, since the number of lower surface side warps is twice the number of upper surface side warps, the density of upper surface side warps becomes small, allowing more upper surface side wefts to be woven compared to the normal ratio of upper surface side warps to lower surface side warps (1:1). As a result, the paper material is more supportive, and the formation and retention of the paper are improved. Further, since the number of knuckles formed by the upper surface side binding yarn in the upper surface side fabric is different from the number of knuckles formed by the lower surface side binding yarn in the upper surface side fabric, the regularity in the alignment of the intersection of the two binding yarns is reduced. As a result, the occurrence of marks is suppressed.

The upper surface side binding yarn and the lower surface side binding yarn may be adjacent to each other.

The upper surface side fabric is woven by upper surface side binding yarns, lower surface side binding yarns, and the upper surface side wefts, and the upper surface side binding yarns and the lower surface side binding yarns may mutually complement the surface texture of the upper surface side fabric. In this way, the mutual complementation of the texture by the two warps improves the surface properties since the texture does not collapse even at the bound parts. Further, the upper surface side binding yarn and the lower surface side binding yarn may mutually complement the surface texture of the lower surface side fabric.

Another embodiment of the present invention also relates to an industrial fabric. This industrial fabric is an industrial fabric in which an upper surface side fabric composed of upper surface side warps and upper surface side wefts and a lower surface side fabric composed of lower surface side warps and lower surface side wefts are bound to each other, wherein a first warp that belongs to the upper surface side warps functions as an upper surface side collapsing yarn that is interwoven with the upper surface side wefts and collapses a part of the surface texture of the upper surface side fabric, a second warp that belongs to the lower surface side warps functions as a lower surface side binding yarn that binds the upper surface side fabric and the lower surface side fabric, the number of the lower surface side warps is twice the number of the upper surface side warps, the upper surface side collapsing yarn and the lower surface side binding yarn are adjacent to each other, the upper surface side fabric is woven with at least the upper surface side collapsing yarn, the lower surface side binding yarn, and the upper surface side wefts, and the upper surface side collapsing yarn and the lower surface side binding yarn mutually complement the surface texture of the upper surface side fabric.

According to this embodiment, since the number of lower surface side warps is twice the number of upper surface side warps, the density of upper surface side warps becomes small, allowing more upper surface side wefts to be woven compared to the normal ratio of upper surface side warps to lower surface side warps (1:1). As a result, the paper material is more supportive, and the formation and retention of the paper are improved. Further, by binding the upper surface side fabric and the lower surface side fabric using the lower surface side binding yarns, the number of intersecting parts is reduced compared to a case where the upper surface side fabric and the lower surface side fabric are bound using the upper surface side binding yarns, and high air permeability can thus be ensured. The mutual complementation of the texture by the upper surface side collapsing yarns and lower surface side binding yarns improves the surface properties since the texture does not collapse even at the bound parts.

The upper surface side collapsing yarn may account for one-third of the total number of warps, and the lower surface side binding yarn may account for one-third of the total number of warps.

The total number of the upper surface side warps may be 30 to 150 per inch.

The total number of the upper surface side wefts may be 20 to 150 per inch.

The surface texture of the upper surface side fabric may be a plain weave. This improves fiber supportability and surface smoothness.

The lower surface side warps may pass above four lower surface side wefts, pass under one lower surface side weft, pass above two lower surface side wefts, and pass under one lower surface side weft in sequence in the lower surface side fabric.

The lower surface side warps may not be binding yarns.

The lower surface side binding yarn may include a first lower surface side binding yarn and a second lower surface side binding yarn adjacent to respective side of the lower surface side warps. In the lower surface side warps, a part to be interwoven with a lower surface side weft along with the adjacent first lower surface side binding yarn, and a part to be interwoven with a lower surface side weft along with the adjacent second lower surface side binding yarn may be arranged in a zigzag pattern. As a result, unlike rib weaving, marks are less likely to occur.

A weave repeat may have 12 shafts of warps and 24 shafts of wefts.

Optional combinations of the aforementioned constituting elements, and implementations of the invention in the form of methods, apparatuses, and systems may also be practiced as additional modes of the present invention.

Advantageous Effects of Invention

According to the present invention, the generation of marks can be suppressed.

DESCRIPTION OF EMBODIMENTS

Figure 1:
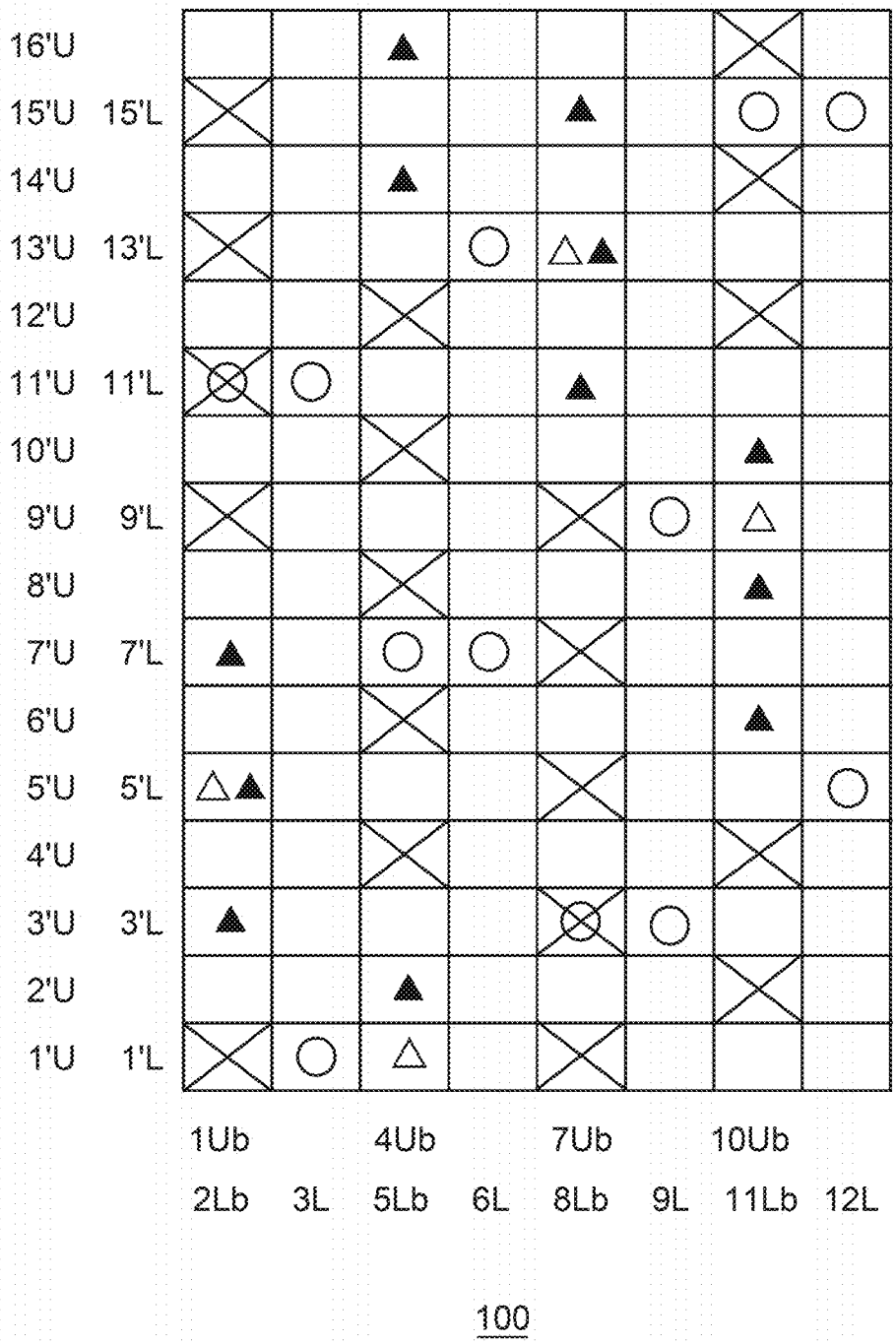
FIG. 1 is a design diagram showing a weave repeat of a multi-layered fabric for papermaking according to the first embodiment.

Hereinafter, the present invention will be explained based on embodiments with reference to the drawings. The same or equivalent constituting elements, members, and processes illustrated in each drawing shall be denoted by the same reference numerals, and duplicative explanations will be omitted appropriately. Further, the embodiments do not limit the invention and are shown for illustrative purposes, and not all the features described in the embodiments and combinations thereof are necessarily essential to the invention. Terms like "first", "second", etc., used in the specification and the claims do not indicate an order or importance by any means unless specified otherwise and are used to distinguish a certain feature from the others.

In the following explanation, "warps" are threads extending along the direction of web conveyance when a multi-layered fabric for papermaking is a looped belt, and "wefts" are threads extending in a direction that intersects the warps. The "upper surface side fabric" is a fabric located on the front surface side where the web is conveyed out of the two sides of a papermaking mesh when a multi-layered fabric is used as the papermaking mesh, and the "lower side fabric" is a fabric located mainly on the back side where a drive roller is in contact out of the two sides of a papermaking belt. The "surface" simply means a surface on the side where the upper surface side fabric or the lower surface side fabric is exposed. While the "surface" of the upper surface side fabric corresponds to the front surface side of a papermaking mesh, the "surface" of the lower surface side fabric corresponds to the back surface side of the papermaking mesh.

Further, "design diagram" represents the minimum repeating unit of a fabric texture and corresponds to a weave repeat of the fabric. In other words, "weave repeat" is repeated from front to back and left to right to form a "fabric". Further, "knuckle" refers to a part where a warp protrudes on the surface by passing over or under a single or multiple wefts.

Further, "binding yarns" means at least some of warps that make up the upper surface side fabric (or lower surface side fabric) and are yarns that bind the upper surface side fabric with the lower surface side fabric by the weaving of a weft of the lower surface side fabric (or the upper surface side fabric) from the back surface side (or the front surface side) with a warp that should normally be woven with only a weft of the upper surface side fabric (or the lower surface side fabric).

First Embodiment

The following is an explanation of the configuration of a multi-layered fabric for papermaking according to the first embodiment with reference to the drawings. FIG. 1 is a design diagram showing a weave repeat of the multi-layered fabric for papermaking according to the first embodiment.

Figure 2:
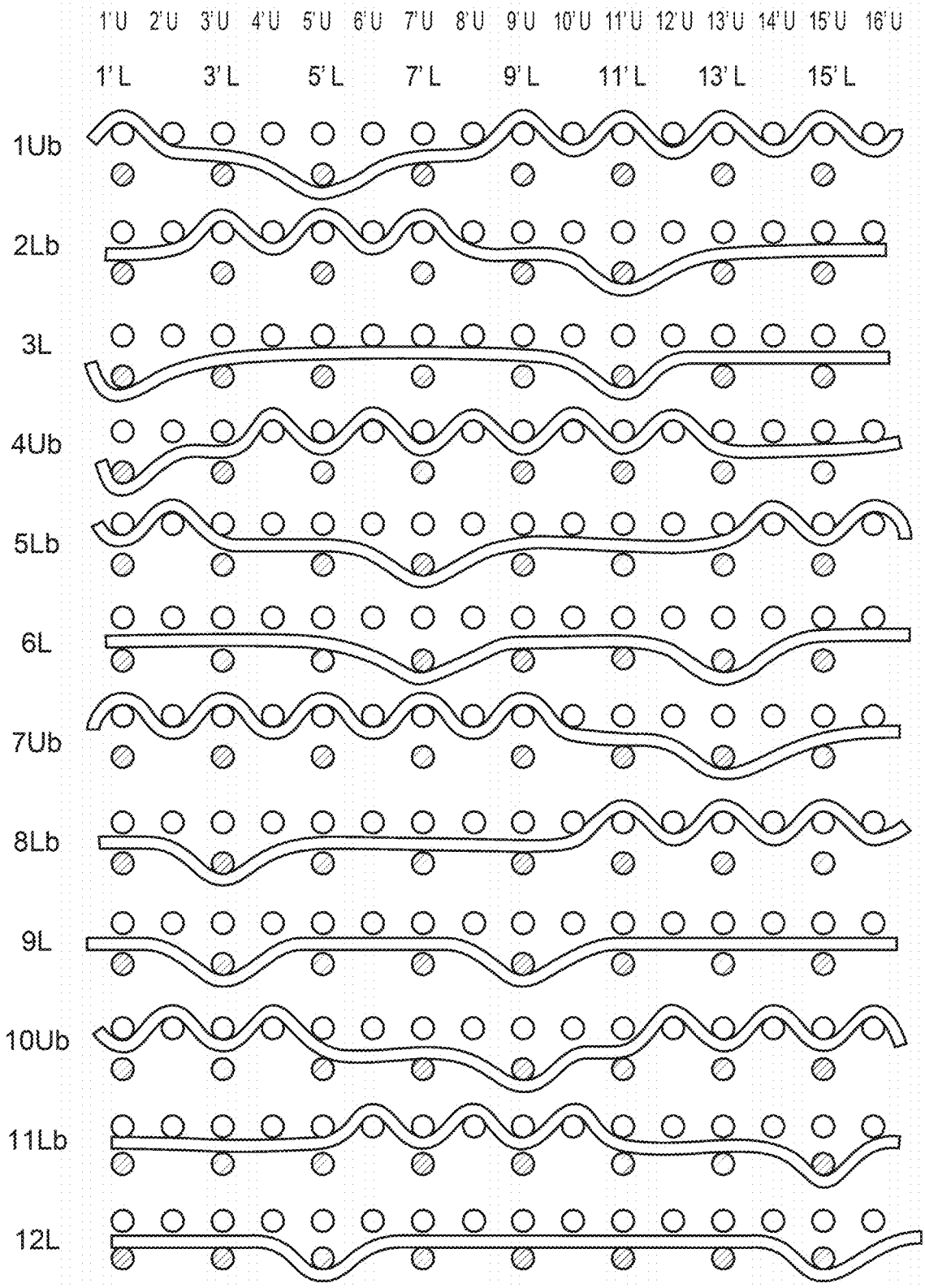
FIG. 2 is a cross-sectional view along each warp in the design diagram shown in FIG. 1.

FIG. 2 is a cross-sectional view along each warp in the design diagram shown in FIG. 1.

In the design diagrams, warps are represented by Arabic numerals, for example, 1, 2, 3, and so on. Wefts are represented by Arabic numerals with a dash, for example, 1', 2', 3', and so on. Upper surface side yarns are denoted by numbers with "U", and lower surface side yarns are denoted by numbers with "L", e.g., 1'U, 2'L, etc. Binding yarns that are binding the upper surface side fabric and the lower surface side fabric are denoted by numbers with "b".

In the design diagrams, ▲ marks indicate that yarns that are to constitute lower surface side warps originally are placed above upper surface side wefts, x marks indicate that upper surface side warps are placed above upper surface side wefts, Δ marks indicate that yarns that are supposed to constitute upper surface side warps originally are placed below lower surface side wefts, and ○ marks indicate that lower surface side warps are placed under lower surface side wefts.

In an industrial fabric 100 according to the first embodiment shown in FIG. 1, an upper surface side fabric composed of upper surface side warps (1Ub, 4Ub, 7Ub, 10Ub) and upper surface side wefts (1'U to 16'U) and a lower surface side fabric composed of lower surface side warps (2Lb, 3L, 5Lb, 6L, . . . , 12L) and lower surface side wefts (1'L, 3'L, . . . , 15'L) are joined to each other.

The weaving method of each warp and each weft in the industrial fabric 100 will be explained next with reference to FIG. 2. The upper surface side warp 1Ub functions as an upper surface side binding yarn that binds the upper surface side fabric and the lower surface side fabric. The upper surface side warp 1Ub is woven in such a manner that the upper surface side warp 1Ub passes above the upper surface side weft 1'U to form a front surface side knuckle, then passes between the upper surface side wefts 2'U to 4'U and the lower surface side weft 3'L and then passes under the lower surface side weft 5'L to form a back surface side knuckle, then passes between the upper surface side wefts 6'U to 8'U and the upper surface side weft 7'L and then passes above the upper surface side weft 9'L to form a front surface side knuckle, then passes under the upper surface side weft 10'U and then passes above the upper surface side weft 11'U to form a front surface side knuckle, . . . , then passes under the upper surface side weft 14'U and then passes above the upper surface side weft 15'U to form a front surface side knuckle, and then passes under the upper surface side weft 16'U.

The lower surface side warp 2Lb is adjacent to the upper surface side warp 1Ub and functions as a lower surface side binding yarn that binds the upper surface side fabric and the lower surface side fabric. The lower surface side warp 2Lb is woven in such a manner that the lower surface side warp 2Lb passes between the upper surface side wefts 1'U to 2'U and the lower surface side weft 1'L and then passes above the upper surface side weft 3'U to form a front surface side knuckle, next passes under the upper surface side weft 4'U and then passes above the upper surface side weft 5'U to form a front surface side knuckle, then passes under the upper surface side weft 6'U and then passes above the upper surface side weft 7'U to form a front surface side knuckle, then passes between the upper surface side wefts 8'U to 10'U and the lower surface side weft 9'L and then passes under the lower surface side weft 11'L to form a back surface side knuckle, and then passes between the upper surface side wefts 12'U to 16'U and the lower surface side wefts 13'L and 15'L.

The lower surface side warp 3L is woven in such a manner that the lower surface side warp 3L passes under the lower surface side weft 1'L to form a back surface side knuckle, then passes between the upper surface side wefts 2'U to 10'U and the lower surface side wefts 3'L, 5'L, 7'L, and 9'L and passes under the lower surface side weft 11'L to form a back surface side knuckle, and then passes between the upper surface side wefts 12'U to 16'U and the lower surface side wefts 13'L and 15'L.

The upper surface side warp 4Ub that functions as an upper surface side binding yarn is woven in such a manner that the upper surface side warp 4Ub passes below the lower surface side weft 1'L to form a back surface side knuckle, then passes between the upper surface side wefts 2'U to 3'U and the lower surface side weft 3'L and then passes above the upper surface side weft 4'U to form a front surface side knuckle, next passes between the upper surface side weft 5'U and the lower surface side weft 5'L and then passes above the upper surface side weft 6'U to form a front surface side knuckle, . . . , then passes between the upper surface side weft 11'U and the lower surface side weft 11'L and then passes above the upper surface side wefts 13'U to 16'U to form a front surface side knuckle, and then passes between the upper surface side wefts 13'U to 16'U and the lower surface side wefts 13'L and 15'L.

The lower surface side warp 5Lb that functions as a lower surface side binding yarn is adjacent to the upper surface side warp 4Ub and is woven in such a manner that the lower surface side warp 5Lb passes between the upper surface side weft 1'U and the lower surface side weft 1'L and passes above the upper surface side weft 2'U to form a front surface side knuckle, then passes between the upper surface side wefts 3'U to 6'U and the lower surface side wefts 3'L and 5'L and passes under the lower surface side weft 7'L to form a back surface side knuckle, then passes between the upper surface side wefts 8'U to 13'U and the lower surface side wefts 9'L, 11'L, and 13'L and then passes above the upper surface side weft 14'U to form a front surface side knuckle, then passes between the upper surface side weft 15'U and the lower surface side weft 15'L, and then passes above the upper surface side weft 16'U to form a front surface side knuckle.

The lower surface side warp 6L is woven in such a manner that the lower surface side warp 6L passes between the upper surface side wefts 1'U to 6'U and the lower surface side wefts 1'L, 3'L, and 5'L and then passes under the lower surface side weft 7'L to form a back surface side knuckle, then passes between the upper surface side wefts 8'U to 12'U and the lower surface side wefts 9'L and 11'L and then passes under the lower surface side weft 13'L to form a back surface side knuckle, and then passes between the upper surface side wefts 14'U to 16'U and the lower surface side weft 15'L.

When compared, the upper surface side warps 7Ub and 10Ub and the lower surface side warps 8Lb, 9L, 11Lb, and 12L shown in FIGS. 1 and 2 are woven in the same way as the upper surface side warps 1Ub and 4Ub and the lower surface side warps 2Lb, 3L, 5Lb, and 6L described above except that the warps are shifted by eight upper surface side wefts in the transport direction. Thus, the explanation of the weaving method thereof will be omitted.

As described, in the industrial fabric 100 according to the present embodiment, the weave repeat shown in FIG. 1 is formed in a state where an upper surface side fabric composed of upper surface side warps (1Ub, 4Ub, 7Ub, 10Ub) and upper surface side wefts (1'U to 16'U) and a lower surface side fabric composed of lower surface side warps (2Lb, 3L, 5Lb, 6L, . . . , 12L) and lower surface side wefts (1'L, 3'L, . . . , 15'L) are joined to each other.

Further, the industrial fabric 100 has a total of 12 shafts of upper surface side warps (1Ub, 4Ub, 7Ub, 10Ub) and lower surface side warps (2Lb, 3L, 5Lb, 6L, . . . , 12L) and a total of 24 shafts of upper surface side wefts (1'U to 16'U) and lower side wefts (1'L, 3'L, . . . , 15'L). Thereby, the industrial fabric 100 exhibits good smoothness compared to, for example, a case of a 48-shaft weft weave repeat since the force by which the upper surface side wefts on which the binding yarns are applied is pulled toward the lower surface side works evenly. Further, in the industrial fabric 100, since the number of times the binding yarns go up and down becomes larger and the number of binding points is increased compared to those in a case of a 48-shaft weft weave repeat, the binding force becomes strong, thus suppressing internal wear.

Further, since the number of lower surface side warps (which is eight) is twice the number of upper surface side warps (which is four), the industrial fabric 100 has a smaller density of upper surface side warps, allowing more upper surface side wefts to be woven compared to the normal ratio of upper surface side warps to lower surface side warps (1:1). As a result, the paper material is more supportive, and the formation and retention of the paper are improved.

Further, the space ratio (gap between warps) of the upper surface side warps increases, and the space ratio of the lower surface side warps decreases. As a result, during dewatering of the material, the flow velocity on the front side of the industrial fabric 100 becomes smaller and the flow velocity on the back side becomes larger, resulting in slow dewatering and improved paper formation. If there is a large amount of water retained inside the mesh, the high-speed rotation of the paper machine causes a phenomenon called splash where water scatters in the form of mist. However, since the surface tension of water on the front surface side is lowered and less water is thus held inside the mesh, the industrial fabric 100 according to the present embodiment can suppress the occurrence of splash.

In the industrial fabric 100 according to the present embodiment, the number of knuckles (which is five) formed by the upper surface side warp 1Ub (4Ub, 7Ub, 10Ub) serving as an upper surface side binding yarn in the upper surface side fabric is different from the number of knuckles (which is three) formed by the lower surface side warp 2Lb (5Lb, 8Lb, 11Lb) serving as a lower surface side binding yarn in the upper surface side fabric. Thus, in the industrial fabric 100, the texture of the upper surface side binding yarn and the texture of the lower side binding yarn are different from each other.

In general, the intersection of two binding yarns tends to have (i) decreased dewaterability and (ii) locally increased draw-in of the upper surface side weft. Therefore, when the intersections are regularly aligned, marks (weft marks, regular diagonal marks) are more likely to occur in those areas. In particular, when the binding yarns have the same texture, the above defects are likely to be caused due to the occurrence of the regularity. Therefore, making the two binding yarns to have different texture as in the industrial fabric 100 reduces the regularity in the alignment of the intersection of the two binding yarns. As a result, the occurrence of marks is suppressed. Further, smoothness and uniform dewaterability are improved, and the formation of the paper is enhanced.

Further, the upper surface side fabric of the industrial fabric 100 is woven by the upper surface side warps (1Ub, 4Ub, 7Ub, 10Ub) serving as upper surface side binding yarns, the lower surface side warps (2Lb, 5Lb, 8Lb, 11Lb) serving as lower surface side binding yarns, and the upper surface side wefts (1'U to 16'U), and the upper surface side binding yarns and the lower surface side binding yarns mutually complement the surface texture of the upper surface side fabric. In this way, the mutual complementation of the texture by the two warps improves the surface properties since the texture does not collapse even at the bound parts. Further, the upper surface side binding yarn and the lower surface side binding yarn mutually complement the surface texture of the lower surface side fabric. Also, in the industrial fabric 100 according to the present embodiment, the surface texture of the upper surface side fabric is a plain weave. This improves fiber supportability and surface smoothness.

Next, an explanation will be given of internal wear inside a papermaking mesh of a multi-layered fabric. In general, if the binding force between an upper mesh (upper surface side fabric) and a lower mesh (lower surface side fabric) is weak, the high speed rotation of a paper machine may cause the upper mesh and the lower mesh to rub against each other, resulting in internal wear of the mesh. When such internal wear occurs, the dewaterability and strength of the mesh decreases, and stable papermaking is thus hindered. Therefore, in the industrial fabric 100 according to the present embodiment, warps that are interwoven only in upper surface side wefts are eliminated, and two thirds of all warps are composed of binding yarns. In this manner, by preventing the presence of warps interwoven only in the upper surface side wefts and increasing the number of binding yarns, the binding force between the upper and lower surface side fabrics can be increased, and internal wear can be suppressed.

Next, an explanation will be given of the texture of the back surface side (surface texture of the lower surface side fabric) of the industrial fabric 100 according to the present embodiment. For example, in the industrial fabric 100, since a single lower surface side weft 11'L is woven with two warps, the lower surface side warp 2Lb and the lower surface side warp 3L, the space between knuckles of the lower surface side weft is larger than that in a texture where one lower surface side weft is woven with one warp. Since wear on the machine surface side is mainly caused in the lower surface side weft, large knuckles of the lower surface side weft improve the life associated with wear.

Further, the lower surface side fabric of the industrial fabric 100 is woven such that lower surface side warps not serving as binding yarns (3L, 6L, 9L, 12L) pass over four lower surface side wefts, pass under one lower surface side weft, pass over two lower surface side weft, and then pass under one lower surface side weft in sequence. For example, in the lower surface side warp 3L, a part to be interwoven with the lower surface side weft 11'L along with the lower surface side warp 2Lb, which is an adjacent lower surface side binding yarn, and a part to be interwoven with the lower surface side weft 1'L along with the upper surface side warp 4U, which is an adjacent upper surface side binding yarn, are arranged in a zigzag pattern. The same applies to the other lower surface side warps (6L, 9L, 12L). As a result, unlike rib weaving, marks are less likely to occur.

Second Embodiment

Figure 3:
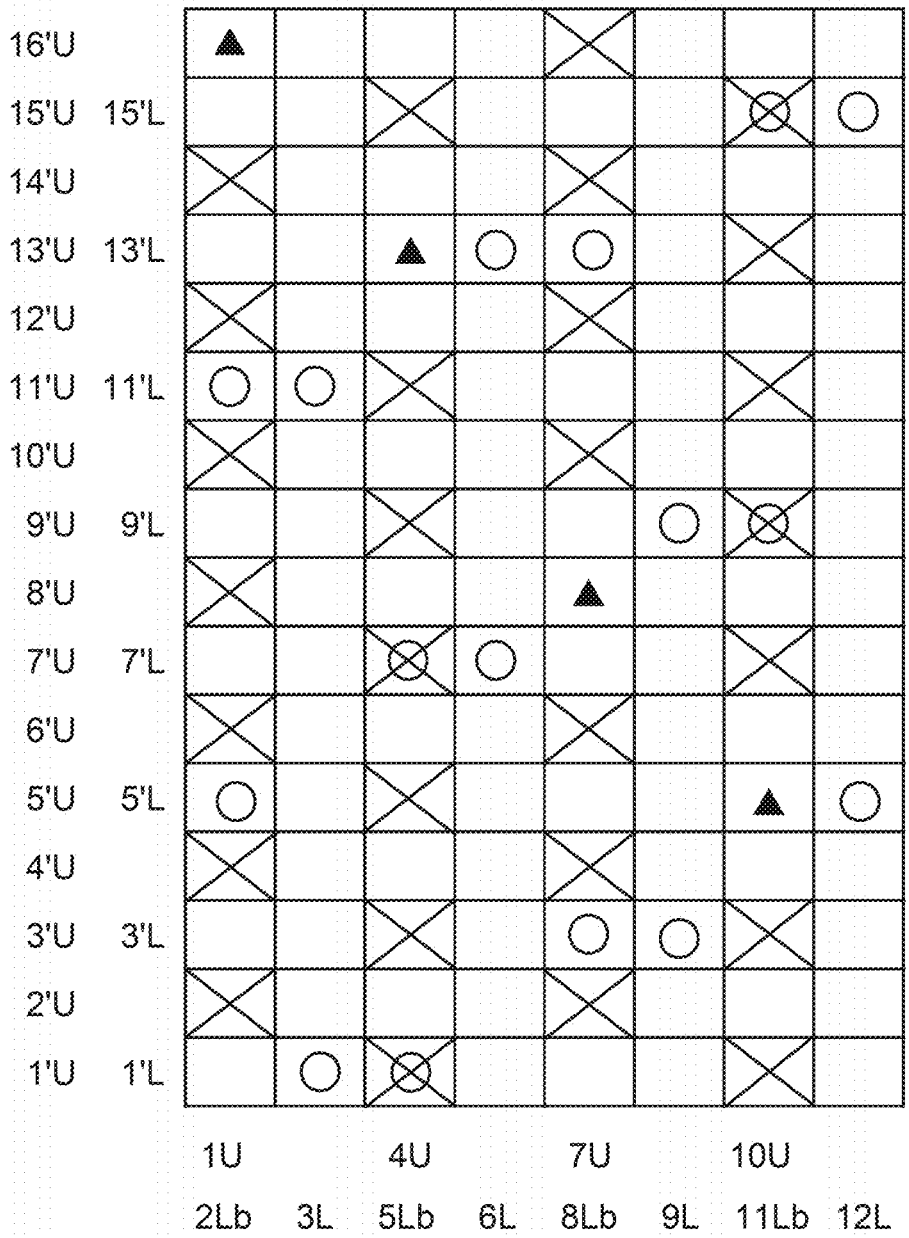
FIG. 3 is a design diagram showing a weave repeat of a multi-layered fabric for papermaking according to the second embodiment.
Figure 4:
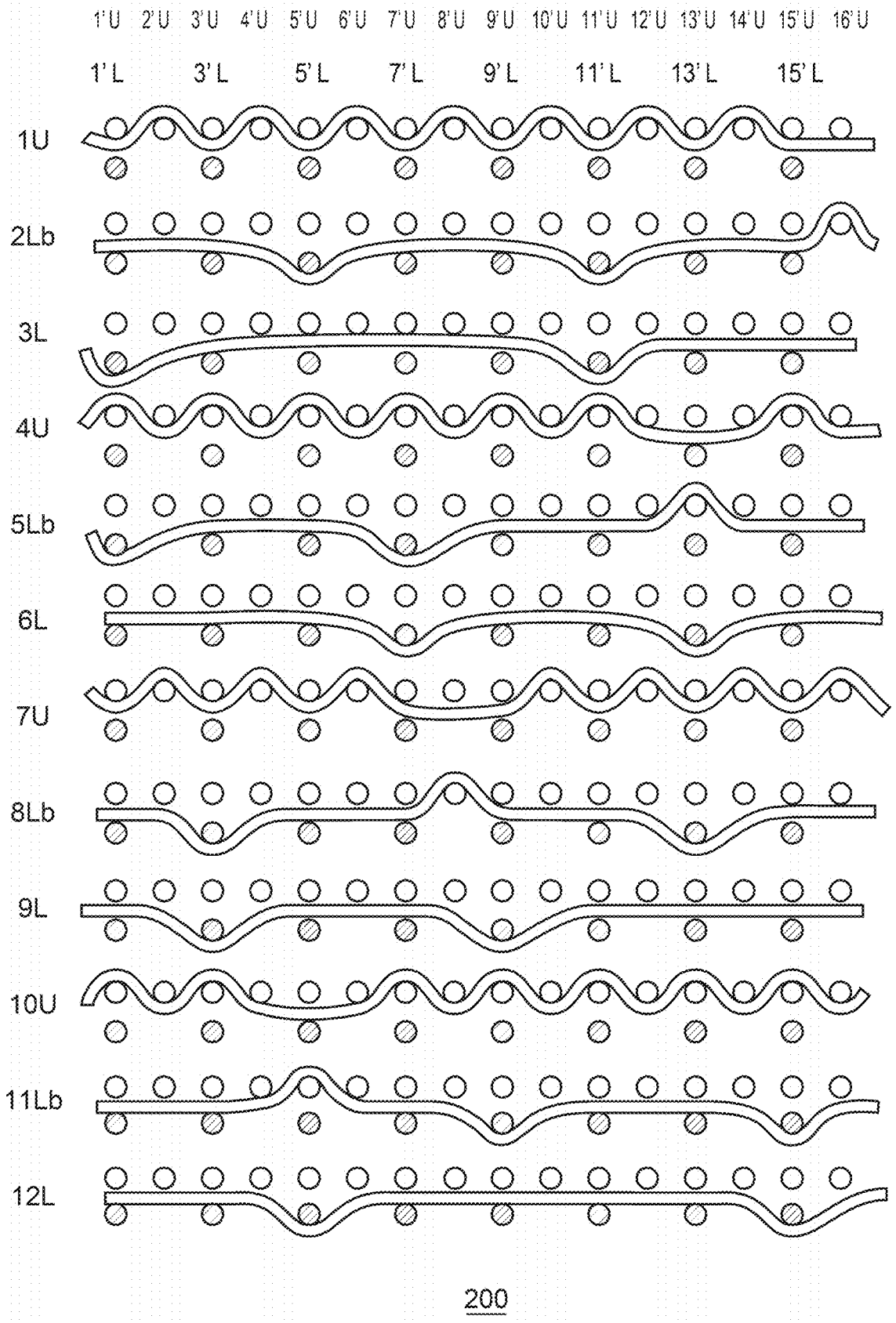
FIG. 4 is a cross-sectional view along each warp in the design diagram shown in FIG. 3.

FIG. 3 is a design diagram showing a weave repeat of a multi-layered fabric for papermaking according to the second embodiment. FIG. 4 is a cross-sectional view along each warp in the design diagram shown in FIG. 3. The signs and marks in each figure are the same as those in the first embodiment, and explanations thereof will be appropriately omitted.

In an industrial fabric 200 according to the second embodiment shown in FIG. 3, an upper surface side fabric composed of upper surface side warps (1U, 4U, 7U, 10U) and upper surface side wefts (1'U to 16'U) and a lower surface side fabric composed of lower surface side warps (2Lb, 3L, 5Lb, 6L, . . . , 12L) and lower surface side wefts (1'L, 3'L, . . . , 15'L) are joined to each other.

The weaving method of each warp and each weft in the industrial fabric 200 will be explained next with reference to FIG. 4. The upper surface side warp 1U is woven in such a manner that the upper surface side warp 1U passes between the upper surface side weft 1'U and the lower surface side weft 1'L and passes above the upper surface side weft 2'U to form a front surface side knuckle, then passes between the upper surface side weft 3'U and the lower surface side weft 3'L and then passes above the upper surface side weft 4'U to form a front surface side knuckle, . . . , then passes between the upper surface side weft 13'U and the lower surface side weft 13'L and then passes above the upper surface side weft 14'U to form a front surface side knuckle, and then passes between the upper surface side wefts 15'U and 16'U and the lower surface side weft 15'L.

The lower surface side warp 2Lb is adjacent to the upper surface side warp 1U and functions as a lower surface side binding yarn that binds the upper surface side fabric and the lower surface side fabric. The lower surface side warp 2Lb is woven in such a manner that the lower surface side warp 2Lb passes between the upper surface side wefts 1'U to 4'U and the lower surface side wefts 1'L and 3'L and passes under the lower surface side weft 5'L to form a back surface side knuckle, then passes between the upper surface side wefts 6'U to 10'U and the lower surface side wefts 7'L and 9'L and then under the lower surface side weft 11'L to form a back surface side knuckle, and then passes between the upper surface side wefts 12'U to 15'U and the lower surface side wefts 13'L and 15'L and then above the upper surface side weft 16'U to form a front surface side knuckle.

The lower surface side warp 3L is woven in such a manner that the lower surface side warp 3L passes under the lower surface side weft 1'L to form a back surface side knuckle, then passes between the upper surface side wefts 2'U to 10'U and the lower surface side wefts 3'L, 5'L, 7'L, and 9'L and passes under the lower surface side weft 11'L to form a back surface side knuckle, and then passes between the upper surface side wefts 12'U to 16'U and the lower surface side wefts 13'L and 15'L.

The upper surface side warp 4U is woven in such a manner that the upper surface side warp 4U passes above the upper surface side weft 1'U to form a front surface side knuckle, then passes under the upper surface side weft 2'U and then above the upper surface side weft 3'U to form a front surface side knuckle, . . . , then passes under the upper surface side weft 10'U and then passes above the upper surface side weft 11'U to form a front surface side knuckle, then passes between the upper surface side wefts 12'U to 14'U and the lower surface side weft 13L' and passes above the upper surface side weft 15'U to form a front surface side knuckle, and then passes under the upper surface side weft 16'U.

The lower surface side warp 5Lb is adjacent to the upper surface side warp 4U and functions as a lower surface side binding yarn that binds the upper surface side fabric and the lower surface side fabric. The lower surface side warp 5Lb is woven in such a manner that the lower surface side warp 5Lb passes under the lower surface side weft 1'L to form a back surface side knuckle, then passes between the upper surface side wefts 2'U to 6'U and the lower surface side wefts 3'L and 5'L and then passes under the lower surface side weft 7'L to form a back surface side knuckle, then passes between the upper surface side wefts 8'U to 12'U and the lower surface side wefts 9'L and 11'L and then passes above the upper surface side weft 13'U to form a front surface side knuckle, and then passes between the upper surface side wefts 14'U to 16'U and the lower surface side weft 15'L.

The lower surface side warp 6L is woven in such a manner that the lower surface side warp 6L passes between the upper surface side wefts 1'U to 6'U and the lower surface side wefts 1'L, 3'L, and 5'L and then passes under the lower surface side weft 7'L to form a back surface side knuckle, then passes between the upper surface side wefts 8'U to 12'U and the lower surface side wefts 9'L and 11'L and then passes under the lower surface side weft 13'L to form a back surface side knuckle, and then passes between the upper surface side wefts 14'U to 16'U and the lower surface side weft 15'L.

When compared, the upper surface side warps 7U and 10U and the lower surface side warps 8Lb, 9L, 11Lb, and 12L shown in FIGS. 3 and 4 are woven in the same way as the upper surface side warps 1U and 4U and the lower surface side warps 2Lb, 3L, 5Lb, and 6L described above except that the warps are shifted by eight upper surface side wefts in the transport direction. Thus, the explanation of the weaving method thereof will be omitted.

As described, in the industrial fabric 200 according to the present embodiment, the weave repeat shown in FIG. 3 is formed in a state where an upper surface side fabric composed of upper surface side warps (1U, 4U, 7U, 10U) and upper surface side wefts (1'U to 16'U) and a lower surface side fabric composed of lower surface side warps (2Lb, 3L, 5Lb, 6L, . . . , 12L) and lower surface side wefts (1'L, 3'L, . . . , 15'L) are joined to each other.

In the industrial fabric 200, the upper surface side warp 1U (4U, 7U, 10U) functions as an upper surface side collapsing yarn that is interwoven with the upper surface side warp and collapses a part of the surface texture of the upper surface side fabric (e.g., not forming a front surface side knuckle only with the upper surface side wefts 16'U), and the second lower surface side warp 2Lb (5Lb, 8Lb, 11Lb) functions as a lower surface side binding yarn binding the upper surface side fabric and the lower surface side fabric.

Further, in the industrial fabric 200, the number of lower surface side warps (which is eight) is twice the number of the upper surface side warps (which is four), the upper surface side warp 1U (4U, 7U, 10U) serving as an upper surface side collapsing yarn is adjacent to the lower surface side warp 2Lb (5Lb, 8Lb, 11Lb) serving as a lower surface side binding yarn, the upper surface side fabric is woven using at least upper surface side collapsing yarns (upper surface side warps 1U, 4U, 7U, 10U), the lower surface side binding yarns (lower surface side warps 2Lb, 5Lb, 8Lb, 11Lb), and the upper surface side wefts 1'U to 16'U, and the upper surface side collapsing yarns (upper surface side warps (1U, 4U, 7U, 10U) and the lower surface binding yarns (lower surface side warps 2Lb, 5Lb, 8Lb, 11Lb) mutually complement the surface texture of the upper surface side fabric.

Since the number of the lower surface side warps (which is eight) is twice the number of the upper surface side warps (which is four), the industrial fabric 200 according to the present embodiment has a smaller density of upper surface side warps, allowing more upper surface side wefts to be woven compared to the normal ratio of upper surface side warps to lower surface side warps (1:1). As a result, the paper material is more supportive, and the formation and retention of the paper are improved.

Further, by binding the upper surface side fabric and the lower surface side fabric using the lower surface side warps 2Lb, 5Lb, 8Lb, and 11Lb serving as lower surface side binding yarns, the number of intersecting parts is reduced compared to a case where the upper surface side fabric and the lower surface side fabric are bound using the upper surface side binding yarns, and high air permeability can thus be ensured. The mutual complementation of the texture by the upper surface side collapsing yarns and lower surface side binding yarns improves the surface properties since the texture does not collapse even at the bound parts. Also, the upper surface side collapsing yarns according to the present embodiment account for one-third of the total number of warps, and the lower surface side binding yarns account for one-third of the total number of warps.

Further, the industrial fabric 200 may have the lower surface side warps 2Lb and 5Lb as lower surface side binding yarns. In the lower surface side warp 3L, a part to be interwoven with the lower surface side weft 11'L along with the adjacent lower surface side warp 2Lb, and a part to be interwoven with the lower surface side weft 1'L along with the adjacent lower surface side warp 5Lb are arranged in a zigzag pattern. The same applies to the other lower surface side warps (6L, 9L, 12L). As a result, unlike rib weaving, marks are less likely to occur.

The industrial fabric 200 according to the second embodiment achieves the operation and effect that are based on the same configuration as that of the industrial fabric 100 according to the first embodiment in addition to the operation and effect described above.

Third Embodiment

Figure 5:
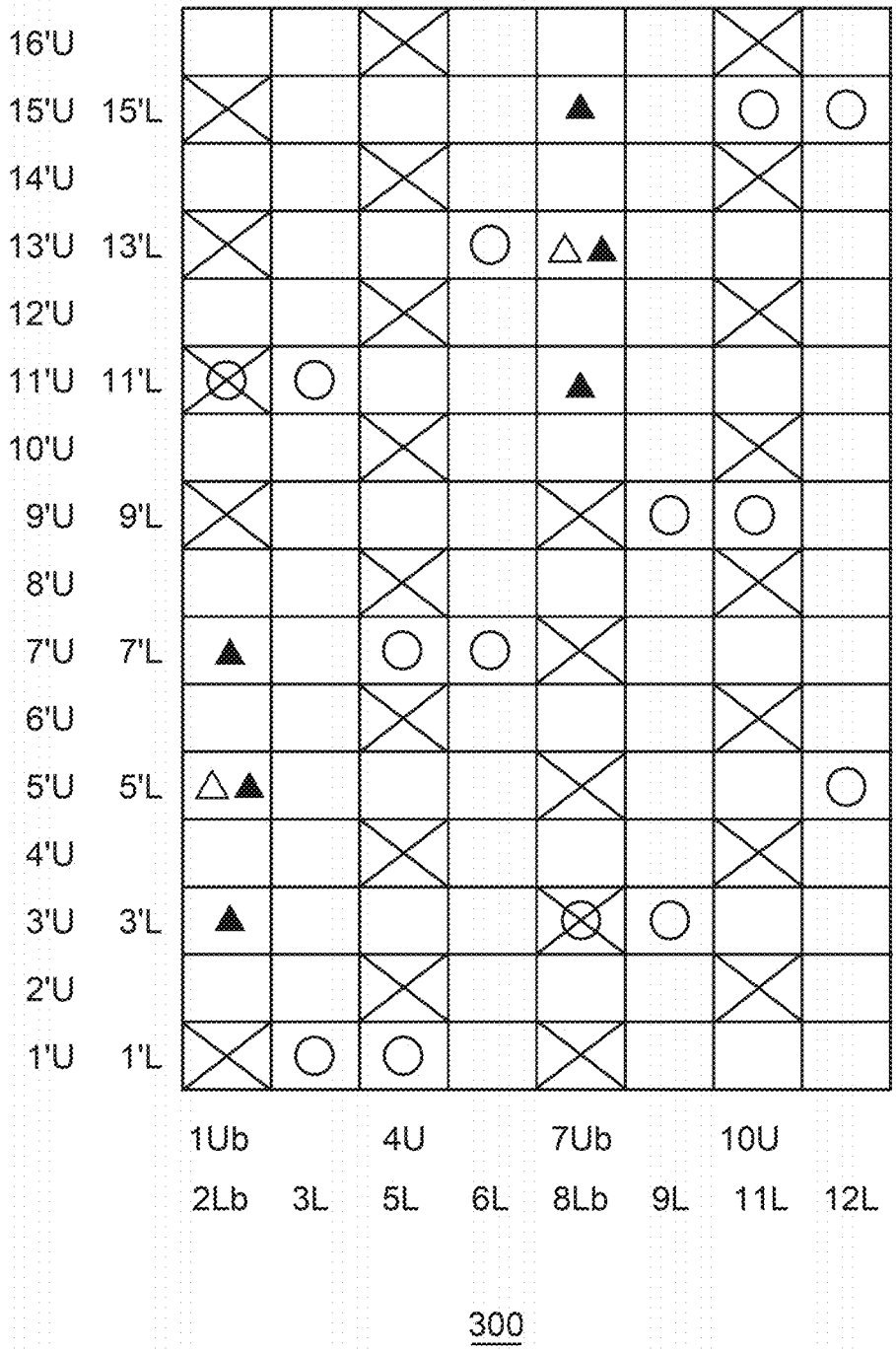
FIG. 5 is a design diagram showing a weave repeat of a multi-layered fabric for papermaking according to the third embodiment.
Figure 6:
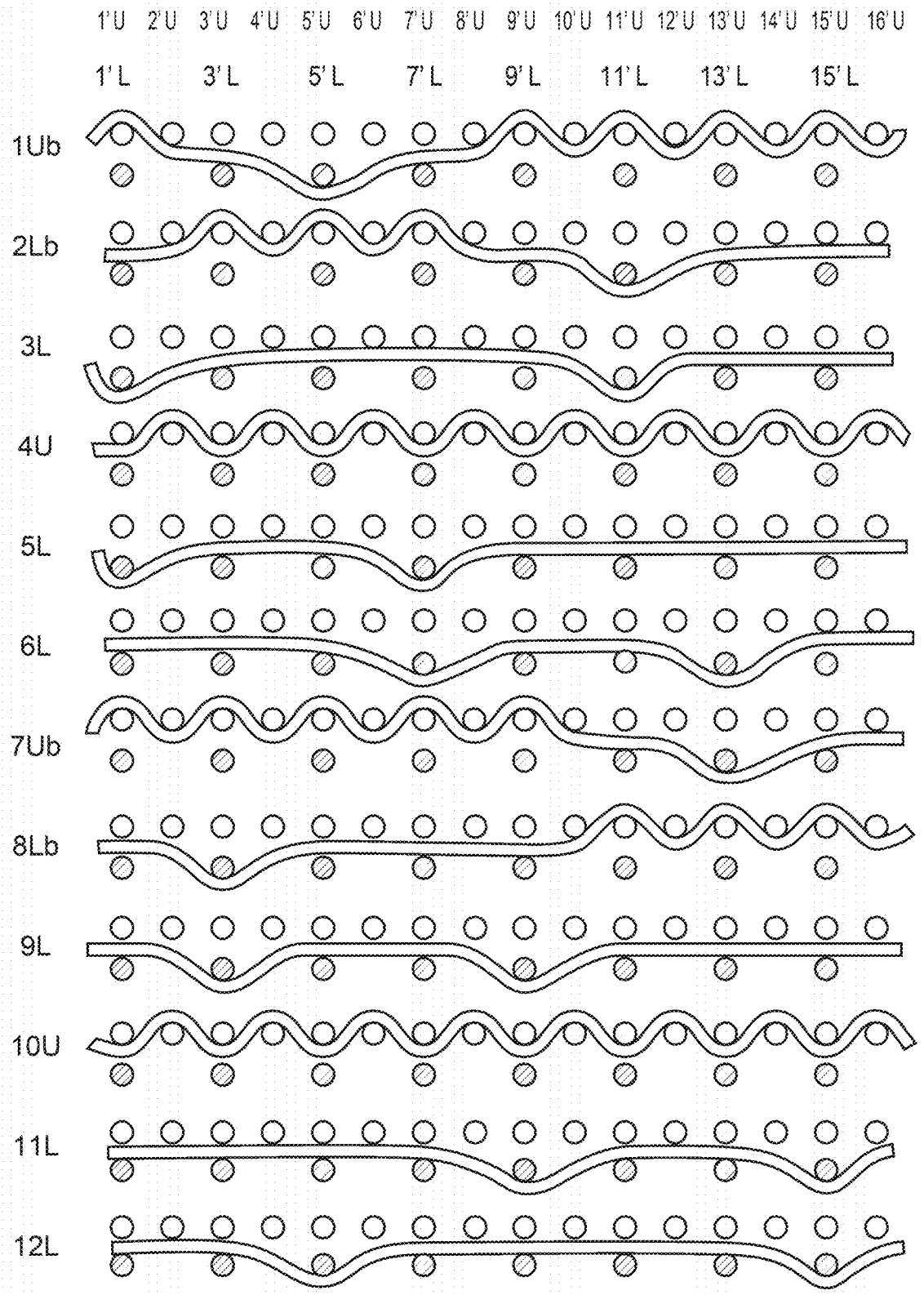
FIG. 6 is a cross-sectional view along each warp in the design diagram shown in FIG. 5.

FIG. 5 is a design diagram showing a weave repeat of a multi-layered fabric for papermaking according to the third embodiment. FIG. 6 is a cross-sectional view along each warp in the design diagram shown in FIG. 5. The signs and marks in each figure are the same as those in the first embodiment and the second embodiment, and explanations thereof will be appropriately omitted.

The main feature of an industrial fabric 300 according to the third embodiment shown in FIGS. 5 and 6 is that the upper surface side warps 4U and 10U not serving as binding yarns are used instead of the upper surface side warps 4Ub and 10Ub serving as the upper surface side binding yarns of the industrial fabric 100 according to the first embodiment and that the lower surface side warps 5L and 11L not serving as binding yarns are used instead of the lower surface side warps 5Lb and 11Lb serving as the lower surface side binding yarns of the industrial fabric 100. In the following, an explanation will be mainly made on the upper surface side warps 4U and 10U and the lower surface side warps 5L and 11L.

The upper surface side warp 4U is woven in such a manner that the upper surface side warp 4U passes between the upper surface side weft 1'U and the lower surface side weft 1'L and then above the upper surface side weft 2U' to form a front surface side knuckle, . . . , and passes between the upper surface side weft 15'U and the lower surface side weft 15'L and then above the upper surface side weft 16U' to form a front surface side knuckle. The upper surface side weft 4U is arranged above the lower surface side warp 5L so as to overlap the lower surface side warp 5L.

The lower surface side warp 5L is woven in such a manner that the lower surface side warp 5L passes under the lower surface side weft 1'L to form a back surface side knuckle, then passes between the upper surface side wefts 2'U to 6'U and the lower surface side wefts 3'L and 5'L and then under the lower surface side weft 7'L to form a back surface side knuckle, and then passes between the upper surface side wefts 8'U to 16'U and the lower surface side wefts 9'L, 11'L, 13'L, and 15'L.

When compared, the upper surface side warps 7Ub and 10Ub and the lower surface side warps 8Lb, 9L, 11Lb, and 12L shown in FIGS. 5 and 6 are woven in the same way as the upper surface side warps 1Ub and 4U and the lower surface side warps 2Lb, 3L, 5L, and 6L except that the warps are shifted by eight upper surface side wefts in the transport direction. Thus, the explanation of the weaving method thereof will be omitted.

An industrial fabric 300 according to the third embodiment achieves the operation and effect that are based on the same configuration as that of the industrial fabric 100 according to the first embodiment.

Fourth Embodiment

Figure 7:
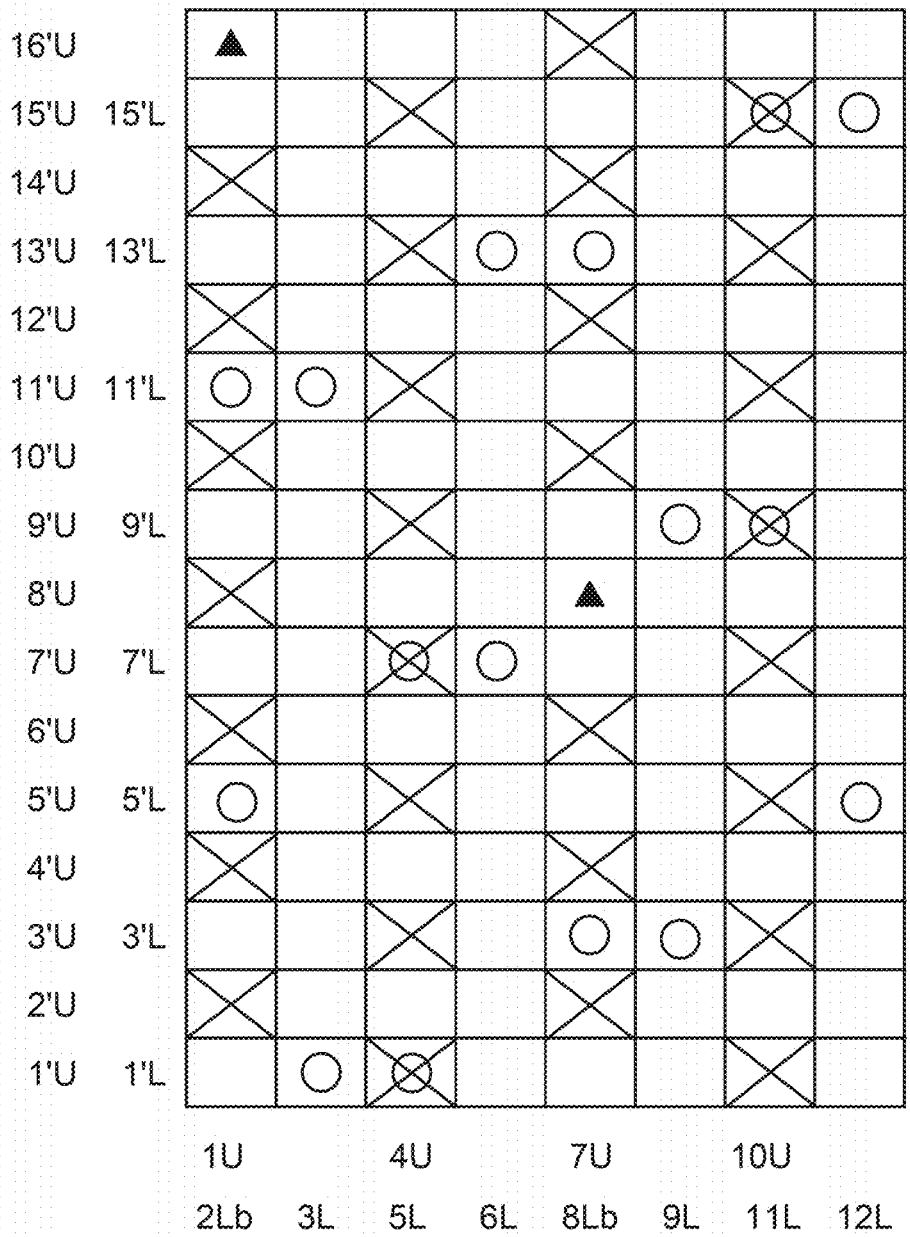
FIG. 7 is a design diagram showing a weave repeat of a multi-layered fabric for papermaking according to the fourth embodiment.
Figure 8:
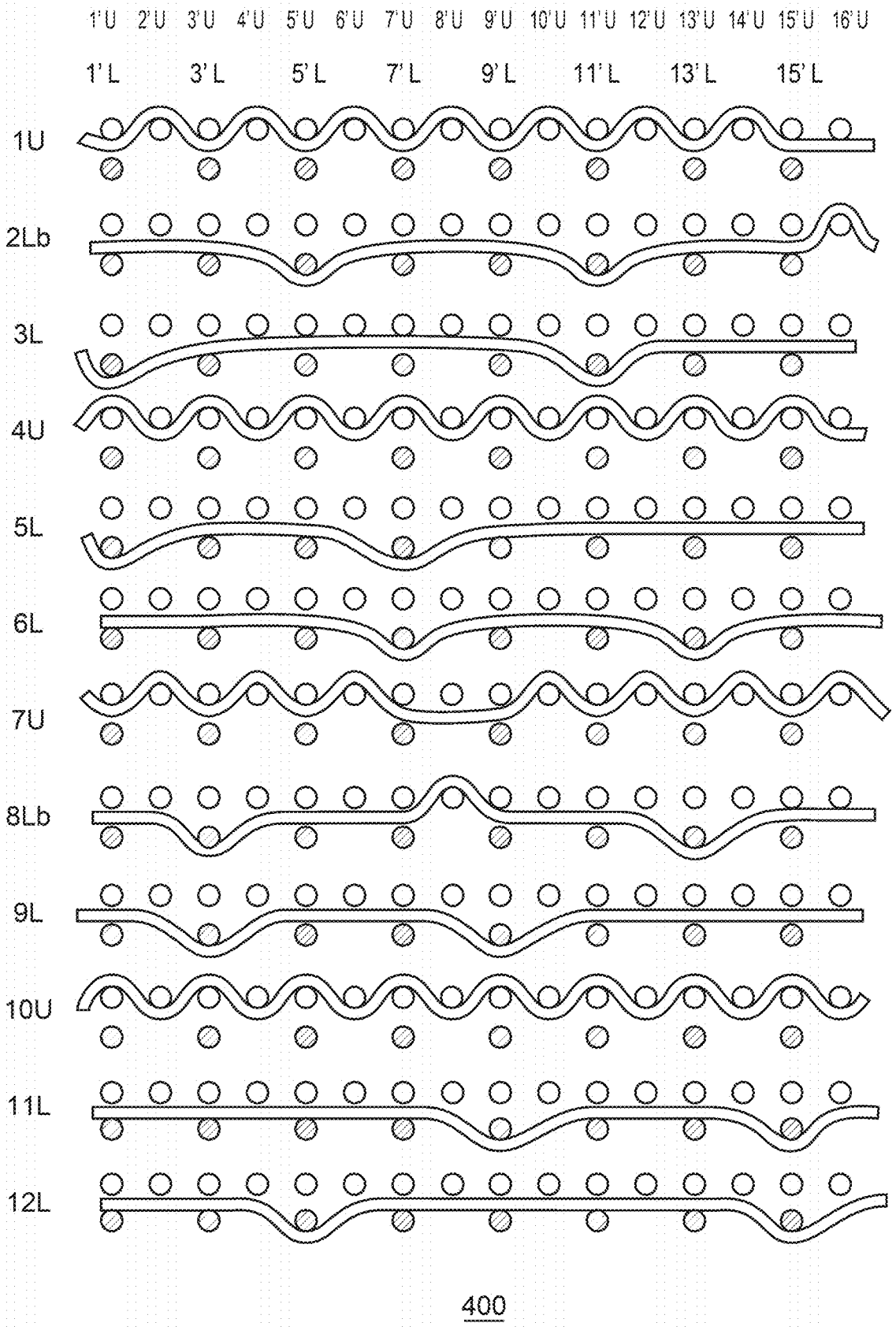
FIG. 8 is a cross-sectional view along each warp in the design diagram shown in FIG. 7.

FIG. 7 is a design diagram showing a weave repeat of a multi-layered fabric for papermaking according to the fourth embodiment. FIG. 8 is a cross-sectional view along each warp in the design diagram shown in FIG. 7. The signs and marks in each figure are the same as those in the first embodiment through the third embodiment, and explanations thereof will be appropriately omitted.

The main feature of an industrial fabric 400 according to the fourth embodiment shown in FIGS. 7 and 8 is that the upper surface side warps 4U and 10U not serving as collapsing yarns are used instead of the upper surface side warps 4U and 10U serving as upper surface side collapsing yarns of the industrial fabric 200 according to the second embodiment and that the lower surface side warps 5L and 11L not serving as binding yarns are used instead of the lower surface side warps 5Lb and 11Lb serving as the lower surface side binding yarns of the industrial fabric 200. An explanation will be given mainly of the upper surface side warps 4U and 10U and the lower surface side warps 5L and 1L in the following.

The upper surface side warp 4U is woven in such a manner that the upper surface side warp 4U passes above the upper surface side weft 1'U to form a front surface side knuckle, then passes under the upper surface side weft 2'U and then above the upper surface side weft 3'U to form a front surface side knuckle, . . . , then passes under the upper surface side weft 14'U and then above the upper surface side weft 15'U to form a front surface side knuckle, and then passes under the upper surface side weft 16'U. The upper surface side weft 4U is arranged above the lower surface side warp 5L so as to overlap the lower surface side warp 5L.

The lower surface side warp 5L is woven in such a manner that the lower surface side warp 5L passes under the lower surface side weft 1'L to form a back surface side knuckle, then passes between the upper surface side wefts 2'U to 6'U and the lower surface side wefts 3'L and 5'L and then under the lower surface side weft 7'L to form a back surface side knuckle, and then passes between the upper surface side wefts 8'U to 16'U and the lower surface side wefts 9'L, 11'L, 13'L, and 15'L.

When compared, the upper surface side warps 7U and 10U and the lower surface side warps 8Lb, 9L, 11L, and 12L shown in FIGS. 7 and 8 are woven in the same way as the upper surface side warps 1U and 4U and the lower surface side warps 2Lb, 3L, 5L, and 6L except that the warps are shifted by eight upper surface side wefts in the transport direction. Thus, the explanation of the weaving method thereof will be omitted.

An industrial fabric 400 according to the fourth embodiment achieves the operation and effect that are based on the same configuration as that of the industrial fabric 200 according to the second embodiment.

[Details of Processing]

An industrial fabric according to each of the above embodiments may be subjected to the following processing. For example, in order to improve the surface smoothness, the front surface side of the industrial fabric may be polished in the range of 0.02 to 0.05 mm. In particular, the front surface side may be polished by 0.02 mm or 0.03 mm.

Further, in order to suppress the fraying of yarns at the ends of the mesh (industrial fabric), the range of 5 mm to 30 mm (particularly the range of 5 mm, 10 mm, or 20 mm) from the ends of the mesh may be coated with a polyurethane resin for reinforcement. The coating of the mesh ends may be coated on one or both sides. The resin may be hot melt polyurethane.

In order to improve the wear resistance of a mesh end, the mesh may be coated in the range of 20 mm to 500 mm (particularly 25, 50, 75, 100, 150, 250, 300, 350, or 400 mm) from the mesh end with three to sixteen (particularly three, four, seven, eight, ten, twelve, fifteen, or sixteen) strips of resin of a width of about 7 mm over the entire length. The plurality of above-mentioned strips of polyurethane resin may be applied to both ends of the mesh or only to one side. The resin may be hot melt polyurethane.

The entire mesh may be coated with resin in order to improve the antifouling performance. In order to allow for the trimming of the paper making width near the mesh end, the mesh may be coated in the range of 10 mm to 500 mm (particularly 10, 15, 20, 25, 30, 40, 50, 75, 100, 150, 200, 250, 300, 350, or 400 mm) from the mesh end with one strip of resin of a width of about 3, 5, 7, 10, 15, or 20 mm over the entire length. The above-mentioned resin may be applied to both ends of the mesh or only to one side. The resin may be polyurethane and may be hot melt. Further, the mesh may have lines of about 25 mm or 50 mm in width across the entire width so that the line bending of the mesh can be seen during use.

[Specifications]

Next, a detailed description of preferred specifications of an industrial fabric according to each of the embodiments will be made. First, an explanation will be made regarding the definition of warp density.

(1) upper surface side warp density in industrial fabric 100=(number of upper surface side binding yarns (1Ub, 4Ub, 7Ub, 10 Ub)+number of lower surface side binding yarns (2Lb, 5Lb, 8Lb, 11Lb)/2/1 inch (2) upper surface side warp density in industrial fabric 200=(number of upper surface side collapsing yarns (1U, 4U, 7U, 10 U))/1 inch (3) upper surface side warp density in industrial fabric 300=(number of upper surface side warps (4U, 10U)+(number of upper surface side binding yarns (1Ub, 7Ub)+number of lower surface side binding yarns (2Lb, 8Lb))/2)/1 inch (4) upper surface side warp density in industrial fabric 400=(number of upper surface side warps (4U, 10U)+number of upper surface side collapsing yarns (1U, 7U))/1 inch (5) lower surface side warp density in industrial fabric 100 and industrial fabric 300=(number of lower surface side warps (3L, 6L, 9L, 12L)+(number of upper surface side binding yarns (1Ub, 4Ub, 7Ub, 10 Ub)+number of lower surface side binding yarns (2Lb, 5Lb, 8Lb, 11Lb)/2)/1 inch (6) lower surface side warp density in industrial fabric 200 and industrial fabric 400=(number of lower surface side warps (3L, 6L, 9L, 12L)+number of lower surface side binding yarns (2Lb, 5Lb, 8Lb, 11Lb)/1 inch In the above definition of warp density, the total number of upper surface side warps according to each embodiment may be 30 to 150 per inch. Further, the total number of upper surface side wefts may be 20 to 150 per inch.

Next, examples of specific yarn combinations are shown below.

First Exemplary Embodiment upper surface side warp:
diameter: 0.12 mm, wire: PET
upper surface side binding yarn:
diameter: 0.12 mm, wire: PET
lower surface side binding yarn:
diameter: 0.12 mm, wire: PET
lower surface side warp:
diameter: 0.15 mm, wire: PET
warp density on upper surface side: 75 yarns/inch
warp density on lower surface side: 150 yarns/inch
upper surface side weft:
diameter: 0.12 mm, wire: PET and polyamide
upper weft density: 100 yarns/inch
lower surface side weft:
diameter: 0.27 mm, wire: PET and polyamide
lower weft density: 50 yarns/inch
mesh thickness: 0.650 mm
air permeability: 150 cm3/cm2/s An industrial fabric woven with yarns according to the first exemplary embodiment has lower warps that are thicker than upper warps and binding yarns and is therefore less likely to stretch in the length direction, allowing for stable operation during use. Further, since more upper wefts can be woven, fiber supportability is improved.

Second Exemplary Embodiment upper surface side binding yarn:
diameter: 0.13 mm, wire: PET
lower surface side binding yarn:
diameter: 0.13 mm, wire: PET
lower surface side warp:
diameter: 0.13 mm, wire: PET
warp density on upper surface side: 70 yarns/inch
warp density on lower surface side: 140 yarns/inch
upper surface side weft:
diameter: 0.12 mm, wire: PET
upper weft density: 100 yarns/inch
lower surface side weft:
diameter: 0.27 mm, wire: PET and polyamide
lower weft density: 50 yarns/inch
mesh thickness: 0.660 mm
air permeability: 150 cm3/cm2/s An industrial fabric woven with yarns according to the second exemplary embodiment can exhibit uniform dewaterability by setting the respective diameters of the upper surface side binding yarns, the lower surface side binding yarns, and the lower surface side warps to be the same.

Third Exemplary Embodiment upper surface side binding yarn:
diameter: 0.12 mm, wire: PET
lower surface side binding yarn:
diameter: 0.12 mm, wire: PET
lower surface side warp:
diameter: 0.22 mm, wire: PET
warp density on upper surface side: 60 yarns/inch
warp density on lower surface side: 120 yarns/inch
upper surface side weft:
diameter: 0.13 mm, wire: PET
upper weft density: 77 yarns/inch
lower surface side weft:
diameter: 0.25 mm, wire: PET and polyamide
lower weft density: 50 yarns/inch
mesh thickness: 0.680 mm
air permeability: 137 cm3/cm2/s In an industrial fabric woven with yarns according to third exemplary embodiment, making the lower surface side warps thicker than the upper surface side binding yarns and the lower surface side binding yarns causes the industrial fabric to be less likely to stretch in the length direction, and the rigidity is thus improved.

Fourth Exemplary Embodiment upper surface side warp:
diameter: 0.17 mm, wire: PET
upper surface side binding yarn:
diameter: 0.17 mm, wire: PET
lower surface side binding yarn:
diameter: 0.17 mm, wire: PET
lower surface side warp:
diameter: 0.17 mm, wire: PET
warp density on upper surface side: 50 yarns/inch
warp density on lower surface side: 100 yarns/inch
upper surface side weft:
diameter: 0.15 mm, wire: PET
upper weft density: 80 yarns/inch
lower surface side weft:
diameter: 0.30 mm, wire: PET and polyamide
lower weft density: 40 yarns/inch
mesh thickness: 0.880 mm
air permeability: 170 cm3/cm2/s In an industrial fabric woven with yarns according to the fourth exemplary embodiment, rigidity is improved by increasing the diameter as a whole.

Although the diameter and density of each yarn can be selected appropriately according to desired performance, for example, the following combinations may be used in the case of warps.

In the case of a warp diameter of 0.13 mm, the upper surface side warp density is 70 yarns/inch, and the lower surface side warp density is 140 yarns/inch.

In the case of a warp diameter of 0.15 mm, the upper surface side warp density is 60 yarns/inch, and the lower surface side warp density is 120 yarns/inch.

In the case of a warp diameter of 0.17 mm, the upper surface side warp density is 50 yarns/inch, and the lower surface side warp density is 100 yarns/inch.

In the case of a warp diameter of 0.20 mm, the upper surface side warp density is 45 yarns/inch, and the lower surface side warp density is 90 yarns/inch.

In the case of a warp diameter of 0.22 mm, the upper surface side warp density is 40 yarns/inch, and the lower surface side warp density is 80 yarns/inch.

In the case of a warp diameter of 0.25 mm, the upper surface side warp density is 35 yarns/inch, and the lower surface side warp density is 70 yarns/inch.

In the case of a warp diameter of 0.30 mm, the upper surface side warp density is 30 yarns/inch, and the lower surface side warp density is 60 yarns/inch.

In the case of wefts, the following combinations may be used.

In the case of an upper weft diameter of 0.12 mm and a lower weft diameter of 0.27 mm, the upper weft density is 100 yarns/inch, and the lower weft density is 50 yarns/inch.

In the case of an upper weft diameter of 0.13 mm and a lower weft diameter of 0.27 mm, the upper weft density is 90 yarns/inch, and the lower weft density is 45 yarns/inch.

In the case of an upper weft diameter of 0.15 mm and a lower weft diameter of 0.30 mm, the upper weft density is 80 yarns/inch, and the lower weft density is 40 yarns/inch.

In the case of an upper weft diameter of 0.17 mm and a lower weft diameter of 0.30 mm, the upper weft density is 70 yarns/inch, and the lower weft density is 35 yarns/inch.

In the case of an upper weft diameter of 0.20 mm and a lower weft diameter of 0.35 mm, the upper weft density is 60 yarns/inch, and the lower weft density is 30 yarns/inch.

In the case of an upper weft diameter of 0.27 mm and a lower weft diameter of 0.40 mm, the upper weft density is 50 yarns/inch, and the lower weft density is 25 yarns/inch.

In the case of an upper weft diameter of 0.30 mm and a lower weft diameter of 0.45 mm, the upper weft density is 40 yarns/inch, and the lower weft density is 20 yarns/inch.

The following is a list of preferred element ranges for an industrial fabric, including the aforementioned examples. The warp diameter is preferably 0.10 mm to 1.0 mm, more preferably 0.1 mm to 0.5 mm, and particularly preferably 0.11 mm to 0.35 mm. The weft diameter is preferably 0.10 mm to 1.0 mm, more preferably 0.12 mm to 0.6 mm, and particularly preferably 0.12 mm to 0.55 mm.

The upper surface side wefts may be composed of only PET wires, only polyamide wires, or PET wires and polyamide wires that are alternately interwoven. The lower surface side wefts may be composed of only PET wires or only polyamide wires or may be composed of PET wires and polyamide wires that are alternately interwoven. Also, in order to reduce the driving load of the machine, low-friction yarns may be woven into the lower surface side wefts.

The ratio of the number of upper surface side wefts to the number of lower surface side wefts may be 1:1, 2:1, 3:1, 4:1, 3:2, 4:3, 5:2, 5:3, or 5:4. The air permeability is preferably 100 cm3/cm2/s to 600 cm3/cm2/s and more preferably 120 cm3/cm2/s to 300 cm3/cm2/s.

The mesh thickness is preferably 0.3 mm to 3.0 mm, more preferably 0.5 mm to 2.5 mm, and particularly preferably 0.5 mm to 1.0 mm. The usage applications include mainly usage as a papermaking or nonwoven fabric belt and may include particularly usage as a papermaking dewatering belt or a spunbond nonwoven fabric conveying belt.

The cross-sectional shape of the warps and wefts according to each of the above-mentioned embodiments is not limited to a circular shape, and yarns having a quadrangular shape, a star shape, etc., and yarns having an elliptical shape, a hollow shape, a sheath-core structure shape, etc., can be used. In particular, by making the cross-sectional shape of the lower warps have a square shape, a rectangular shape, or an elliptical shape, the cross-sectional area of the yarns can be increased, and elongation resistance and rigidity can thus be improved.

Further, the yarn material can be freely selected as long as the yarn satisfies the desired characteristics, and polyethylene terephthalate, polyester, polyamide, polyphenylene sulfide, polyvinylidene fluoride, polypropylene, aramid, polyether ether ketone, polyethylene naphthalate, polytetrafluoroethylene, cotton, wool, metals, thermoplastic polyurethane, thermoplastic elastomers, etc., can be used. Needless to say, yarns prepared from a copolymer and yarns prepared by blending or adding various substances to such a material may be used according to the purpose. In general, polyester monofilaments having rigidity and excellent dimensional stability are preferably used as yarns constituting industrial fabrics.

The number of warp shafts is preferably 6 shafts, 9 shafts, 12 shafts, 15 shafts, 18 shafts, or 24 shafts. Further, the number of weft shafts is preferably 8 shafts, 12 shafts, 16 shafts, 20 shafts, 24 shafts, 28 shafts, 32 shafts, 36 shafts, 40 shafts, 44 shafts, or 48 shafts.

While the invention has been described by referring to the above-described embodiment, the invention is not limited to the above-described embodiment, and the appropriate combination of the configurations of the embodiment or the substitution thereof is also included in the invention. Further, the combination of the embodiments or the process sequence thereof may be appropriately set or various modifications in design may be added to the embodiments based on the knowledge of the person skilled in the art. An embodiment having such modifications may be also included in the scope of the invention.

INDUSTRIAL APPLICABILITY

The present invention relates to industrial fabrics used for paper machines.

REFERENCE SIGNS LIST

1'L lower surface side weft, 1'U upper surface side weft, 1Ub upper surface side warp, 2Lb lower surface side warp, 3L lower surface side warp, 4Ub upper surface side warp, 5Lb lower surface side warp, 6L lower surface side warp, 7Ub upper surface side warp, 8Lb lower surface side warp, 9L lower surface side warp, 10Ub upper surface side warp, 11Lb lower surface side warp, 12L lower surface side warp, 100 industrial fabric

The invention claimed is:

1. An industrial fabric in which an upper surface side fabric composed of upper surface side warps and upper surface side wefts and a lower surface side fabric composed of lower surface side warps and lower surface side wefts are bound to each other, wherein a first warp that belongs to the upper surface side warps functions as an upper surface side binding yarn that binds the upper surface side fabric and the lower surface side fabric, a second warp that belongs to the lower surface side warps functions as a lower surface side binding yarn that binds the upper surface side fabric and the lower surface side fabric, the number of knuckles formed by the upper surface side binding yarn in the upper surface side fabric is larger than the number of knuckles formed by the lower surface side binding yarn in the upper surface side fabric, and the number of the lower surface side warps is twice the number of the upper surface side warps.

2. The industrial fabric according to claim 1, wherein the upper surface side binding yarn and the lower surface side binding yarn are adjacent to each other.

3. The industrial fabric according to claim 1, wherein the upper surface side fabric is woven with the upper surface side binding yarn, the lower surface side binding yarn, and the upper surface side wefts, and the upper surface side binding yarn and the lower surface side binding yarn mutually complement the surface texture of the upper surface side fabric.

4. An industrial fabric in which an upper surface side fabric composed of upper surface side warps and upper surface side wefts and a lower surface side fabric composed of lower surface side warps and lower surface side wefts are bound to each other, wherein a first warp that belongs to the upper surface side warps functions as an upper surface side collapsing yarn that is interwoven with the upper surface side wefts and collapses a part of the surface texture of the upper surface side fabric, a second warp that belongs to the lower surface side warps functions as a lower surface side binding yarn that binds the upper surface side fabric and the lower surface side fabric, the number of the lower surface side warps is twice the number of the upper surface side warps, the upper surface side collapsing yarn and the lower surface side binding yarn are adjacent to each other, the upper surface side fabric is woven with at least the upper surface side collapsing yarn, the lower surface side binding yarn, and the upper surface side wefts, and the upper surface side collapsing yarn and the lower surface side binding yarn mutually complement the surface texture of the upper surface side fabric.

5. The industrial fabric according to claim 4, wherein the upper surface side collapsing yarn accounts for one-third of the total number of warps, and the lower surface side binding yarn accounts for one-third of the total number of warps.

6. The industrial fabric according to claim 1, wherein the total number of the upper surface side warps is 30 to 150 per inch.

7. The industrial fabric according to claim 1, wherein the total number of the upper surface side wefts is 20 to 150 per inch.

8. The industrial fabric according to claim 1, wherein the surface texture of the upper surface side fabric is a plain weave.

9. The industrial fabric according to claim 1, wherein the lower surface side warps pass above four lower surface side wefts, pass under one lower surface side weft, pass above two lower surface side wefts, and pass under one lower surface side weft in sequence in the lower surface side fabric.

10. The industrial fabric according to claim 9, wherein the lower surface side warps are not binding yarns.

11. The industrial fabric according to claim 10, wherein the lower surface side binding yarn includes a first lower surface side binding yarn and a second lower surface side binding yarn adjacent to respective side of the lower surface side warps, and in the lower surface side warps, a part to be interwoven with a lower surface side weft along with the adjacent first lower surface side binding yarn, and a part to be interwoven with a lower surface side weft along with the adjacent second lower surface side binding yarn are arranged in a zigzag pattern.

12. The industrial fabric according to claim 1, wherein a weave repeat has 12 shafts of warps and 24 shafts of wefts.

* * * * *